United States Patent [19]

Marteau d'Autry

[11] Patent Number: 4,474,071

[45] Date of Patent: Oct. 2, 1984

[54] PIPETTE

[76] Inventor: Eric Marteau d'Autry, 72, rue Gambetta, Villiers-le-Bel, France, 95

[21] Appl. No.: 426,103

[22] Filed: Sep. 28, 1982

[30] Foreign Application Priority Data

Oct. 28, 1981 [FR] France ..... 81 20220

[51] Int. Cl.[3] ..... B01L 3/02

[52] U.S. Cl. ..... 073/864.13

[58] Field of Search ..... 73/864.01, 864.13, 864.14; 422/100

[56] References Cited

U.S. PATENT DOCUMENTS

| | | | |
|---|---|---|---|
| 4,154,108 | 5/1979 | Vollinger et al. | 73/864.13 |
| 4,283,950 | 8/1981 | Teryamaki | 73/864.14 |
| 4,362,063 | 12/1982 | Marteau d'Autry | 73/864.13 |
| 4,362,064 | 12/1982 | Marteau d'Autry | 73/864.13 |

*Primary Examiner*—Gerald Goldberg
*Assistant Examiner*—Hezron Williams
*Attorney, Agent, or Firm*—Mason, Kolehmainen, Rathburn & Wyss

[57] ABSTRACT

The pipette according to the invention has a body of the pipette at the lower end of which is fitted an end fitting of a calibrated capillary tube in which a piston is movable, and a gripping device at the upper end of the piston. It is characterized in that the piston has, in the region of its upper end intended to be gripped by the gripping device, a flange adapted to cooperate at its upper face with the free ends of the resilient fingers of the gripping device and by its lower face with an abutment surface arranged on the interior surface of the said end fitting of the capillary tube.

10 Claims, 3 Drawing Figures

PIPETTE

The present invention relates to an improvement in positive displacement precision pipettes intended for sampling and dispensing small quantities of liquid.

In the prior art, such positive displacement precision pipettes are already known, which are of the type comprising a substantially tubular body of the pipette at the lower end of which is disposed a calibrated capillary tube in which is displaceable, in a fluid-tight manner and against an upwards-directed return spring force exerted by a main spring, a piston controlled in its downwards displacement by a control rod extending beyond the upper end of the said body of the pipette, and a device for gripping the upper end of the piston, which is of the type having resilient fingers opening radially by movement against the force exerted by a second spring with a greater strength than that of the main spring and which is rigid in movement with the said control rod. Such a positive displacement pipette is for example described in the applicant's French patent application No. 79 01335.

This general type of positive displacement pipette has led to the objective of an improvement designed to permit a simultaneous ejection of the capillary end fitting and the piston without the operator having to directly handle the capillary and/or the piston. It is clear that, when handling radioactive samples or again all other samples of contaminated liquids, it is settled policy to be able to easily ensure such simultaneous ejection of the capillary end fitting and of the piston which constitute the only parts coming into direct contact with the sampled contaminated liquid.

Such an improvement was achieved with the help of a positive displacement precision pipette having an end fitting of the calibrated capillary tube, adapted to cooperate by engaging on the lower free end of the body of the pipette, the opening in this end permitting passage of at least a part of the gripping device, which in the vicinity of the end of its downwards stroke, comes in direct contact with an abutment arranged on the interior surface of the end fitting for ensuring the simultaneous ejection of the end fitting and of the piston which remains captive in the capillary opening. This improvement is to be found described in a detailed manner in the French patent application No. 80 00605 in the name of the present applicant and of which the teachings are incorporated by reference in the present description.

In practice, such a positive displacement pipette presents various difficulties in connection with calibration. In effect, a perfect calibration of such a pipette can only be obtained with certainty if the upper end of the piston always occupies, from one operation to the next, the same vertical position in the gripping device. To obtain such a result, it was provided that the upper end of the piston be brought into direct contact with the bottom of the central opening arranged between the resilient fingers of the gripping device. It is clear that this correct positioning of the upper free end of the piston, for the one part necessitates correct manufacture of this end and so particularly prohibits the presence of burrs often experienced during the manufacture of the pistons; and for the other part such positioning turns out to be unfavourably influenced by the presence of all sorts of deposits which, in the course of use of the pipette, can accumulate at the bottom of the gripping device. Such a clogging at the bottom of the opening arranged between the fingers of the gripping device thus provokes a shifting downwards of the piston in its capillary tube, which falsifies the calibration of the pipette.

This type of pipette presents a further inconvenience that, for bringing the piston to its upper limited position—attained when the free upper end comes into abutment with the bottom of the gripping device—it is necessary to exert a force on the lower end of the piston which extends beyond the bore of the capillary tube. This operation of the correct positioning of the piston was habitually effected by the operator supporting the extended part of the piston either with the help of his finger or the help of his bench. This operation was then intolerable when the pipette was used for taking sterile samples, inasmuch as during the correct positioning of the piston in its capillary tube, the operator risks contaminating the free end of the piston and possibly the end of the capillary tube.

The present invention has for its object the provision of a positive displacement pipette which permits the above inconveniences to be avoided.

According to the present invention, the positive displacement precision pipette is characterized in that the piston has, in the region of its upper end intended to be gripped by the gripping device, a flange adapted to cooperate at its upper face with the free end of the gripping device and at its lower face with an abutment surface on the interior surface of the said end fitting of the capillary tube.

Other features and advantages of the pipette of the invention will be apparent from reading of the detailed description below with particular reference to the accompanying drawings in which.

Figure 1:
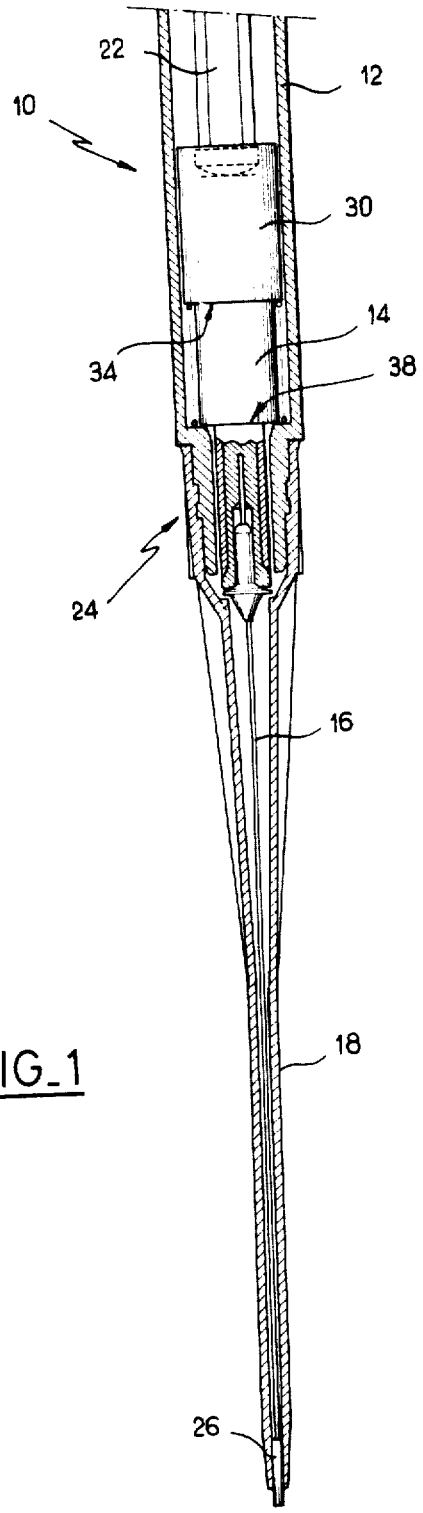
FIG. 1 shows the lower part of a positive displacement pipette according to the invention.

The positive displacement pipette according to the invention has a substantially tubular body 10, which in one particular construction can be made in two separate parts joined together by screwing. The upper part or case (not shown) allows for example the incorporation of a mechanism for adjusting and setting of the volume to be sampled and dispensed, and the lower tubular part serves principally to guide the gripping device 14 for the piston 16. The particular adjusting and setting mechanism does not form part of the present invention and will not therefore be described in detail here. Such a mechanism is for example to be found described in a detailed manner in French patent application No. 80 00130 filed in the name of the present applicant and the teachings of which are incorporated herein by reference.

In a conventional manner, at the lower end of the part 12 of the pipette 10 is disposed a calibrated capillary tube 18 in which is moved, in a fluid tight manner and against an upwards-directed return spring force exerted by a main spring 20, a piston 16 controlled in its displacement by a control rod 22 extending beyond the upper end of the case of the body of the pipette 10.

In accordance with the present invention, the pipette has an end fitting 24 which ends in a calibrated capillary tube 18 and which is adapted to cooperate by engagement with the lower free end of the body of the pipette 10. In an advantageous manner, such end fitting 24 may be made of thermoplastic material chosen for resistance to the samples with which it will be in contact. It may for example be made in polypropylene or in any other semi-rigid thermoplastic material. In such a type of pipette, it is indispensable that the piston 16 has at least one sealing zone coming into intimate contact with the interior surface of the capillary tube 18. Such a piston 16 may for example be advantageously made in the form of a stainless steel wire having a coating, for example a coating of polyethylene or of polytetrafluoroethylene, at the level of the sealing zone 26. As shown in FIG. 1, such a coating may for example take a generally cylindrical form or again may be provided at its periphery with at least one annular sealing lip coming into intimate contact with the interior surface of the capillary tube 18.

Such a type of pipette also includes a gripping device 14 for the upper end of the piston 16, which is of the type having resilient fingers 28 opening radially by movement against the force exerted by a second spring (not shown) having a much greater strength than that of the main spring 20. It is obvious that such a gripping device 14 must be rigid in movement with the control rod 22 of the pipette.

The detail of the construction of this gripping device 14 does not form part of the present invention, and is not therefore shown on the accompanying drawings. In referring to the French patent application No. 80 00605, it may be learned that this gripping device may for example be in the form of an independent block comprising a collet—as it is properly called—terminating at its lower end in resilient fingers 28 and screwed at its other end into a support for the collet. This collet support is adapted to slide, against the force exerted by the second spring and following a partial stroke in the upper part of an opening arranged in the collet-holder 30. This last collet-holder 30 itself slides inside the lower part 12 of the body of the pipette 10 against the force exerted by the main spring 20. It is important that the outside of the resilient fingers 28 has a surface flairing outwards adapted to be applied closely against the lower conical opening 32 of the device 14 (see, for example, FIG. 1) under the action of the force exerted by the second spring.

It may be seen on FIG. 1 that the assembly of this block which constitutes the gripping device for the piston 16, is resiliently urged upwards under the action of the force exerted by the main spring 20. For this purpose, the collet-holder 30 presents a shoulder 34 against which the main spring 20 bears. At its lower end, the main spring 20 is in fixed abutment on a shoulder 36 arranged on the lower surface of the lower part 12 of the body of the pipette 10, in the region of its free lower end. The collet-holder 30 can advantageously come into upper abutment with a setting screw (not shown) of which the vertically variable position permits setting of the usable stroke for sampling and dispensing of the liquid sample.

The present invention is not however limited to such an adjustable type of pipette, but equally well extends to fixed pipettes, i.e. to pipettes in which the adjustment screw is replaced by an abutment limiting the upwards stroke which abutment remains fixed in position with respect to the body of the pipette 10.

Figure 2:
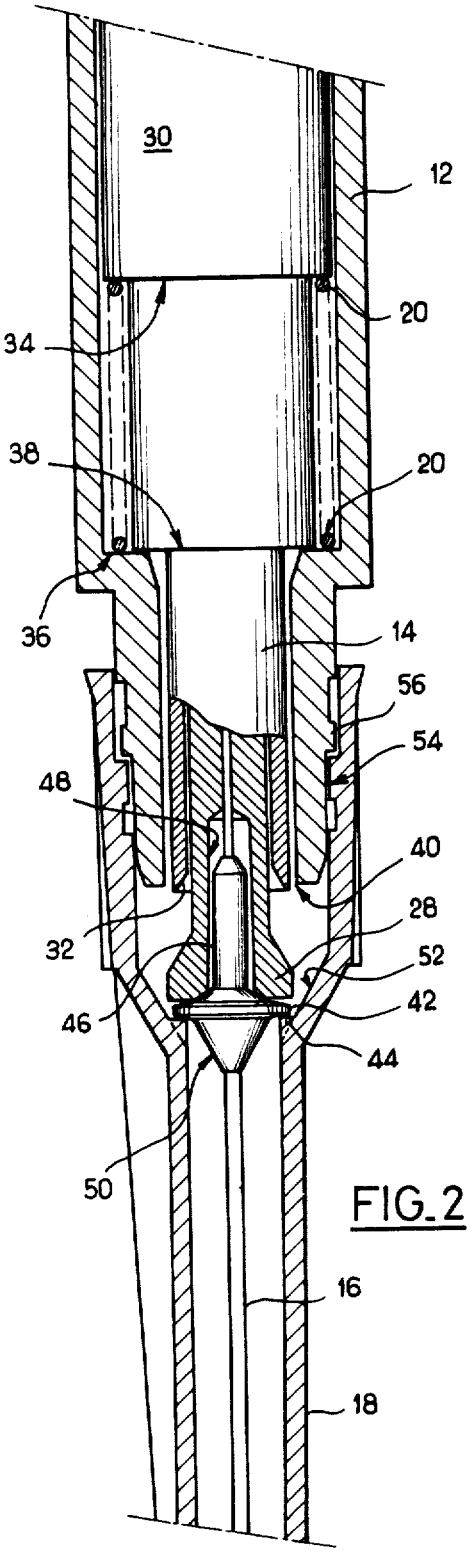
FIG. 2 shows on a larger scale the portion of the pipette incorporating the improvement of the invention.

The abutment limiting the downwards usable stroke for dispensing from the pipette is to be found at the level of a shoulder 38 arranged in the region of the lower part of the collet-holder 30. This shoulder 38 is adapted to cooperate with the corresponding shoulder 36 arranged in the region of the lower end of the body of the pipette 10. Such a lower limited position of the collet-holder means 14 is shown in FIG. 2. It should be noted that this position is obtained at the end of the complete compression of the main spring 20.

The opening 40 of the lower free end of the body of the pipette 10 is arranged in a manner to permit the passage through of at least a part of the gripping device 14 which, after compression of the second spring and the finish of the downwards stroke, assures the simultaneous ejection of the said end fitting 24 and the piston 16 which remains captive in the capillary tube 18.

To obtain such a simultaneous ejection of the piston 16 and the end fitting 24 of the capillary tube 18, in avoidance of the above noted inconveniences of the prior art, the piston 16 has a flange 42 situated in the region of its upper end intended to be grasped by the resilient fingers 28 of the gripper 14. This flange 42 presents an upper face adapted to cooperate with the free tips of the resilient fingers 28 of the gripping device 14, and a lower face adapted to cooperate with an abutment surface arranged on the interior wall of the end fitting 24 of the capillary tube 18, preferably in the region of the junction of the upper bell-mouthed part of the end fitting and the capillary tube 18 proper.

As is particularly shown in FIG. 2, the flange 42 has a transverse dimension substantially equal to the exterior diameter of the resilient fingers 28 in their splayed open state of the gripping device 14. This flange 42 has at its lower face at least one annular peripheral zone defining an abutment surface which is substantially perpendicular to the axis of the piston 16. This particular arrangement permits assurance of a good abutment cooperation between the lower abutment surface of the flange 42 and the abuttment surface 44 arranged on the interior wall of the end fitting 24. At its upper face, the flange 42 is formed in a manner to perfect its application against the profile of the opening zone of the grip 14. Given that in practice the resilient fingers 28 of the gripping device present in the region of their free ends an internally bevelled face designed to facilitate introduction of the upper end of the piston 16, the upper face of the flange 42 also has a central part having a slightly conical profile.

In fact, the upper free end of the piston 16 ends, beyond the said flange 42, in a little substantially cylindrical boss 46. This boss 46 can equally advantageously take the form of a very slightly tapered cone inverted in comparison with the central conical profile 50. The boss 46, designed solely to facilitate the gripping of the piston 16 between the resilient fingers 28 of the gripping device 14, has an axial dimension, extending from the free upper end of the piston 16 to the upper surface of the flange 42, which remains substantially less than the depth of the central orifice arranged between the resilient fingers of the gripping device 14.

The lower face of the flange 42 has, in its central part, centring means, cooperating for example with the abutment 44 arranged on the interior wall of the end fitting 24 of the capillary tube 18. These means which permit assurance of the centring of the upper part of the piston, are advantageously in the form of a central conical profile 50 being slightly less than the internal diameter of the capillary tube 18. It is clear that in practice, the flange 42, the boss 46 and the centring means 50 provided at the lower face are advantageously made in a single and the same piece of moulded plastic material.

When one wishes to use the positive displacement pipette according to the invention, it is necessary to equip the lower part of the case with an end fitting 24 of a capillary tube 18, in which is movable a piston 16. To do this there are two possibilities.

According to the first possibility, one keeps the pistons 16 and the end fittings 24 of the capillary tubes stocked separately. In this case, one exerts on the pressure button provided on the upper free end of the control rod 22 a pressure sufficient to compress both the first and second springs. This operation brings about the downwards displacement of the movable portion of the pipette, and the opening of the resilient fingers 28 of the gripping device 14. It is then possible to introduce the upper boss 46 of the piston 16 between the opened resilient fingers of the gripping device 14.

This introduction and positioning of the piston 16 is carried out in an approximately vertical position, the essential being to ensure the gripping of the piston by the gripping device 14. Next, one forcibly engages the end fitting 24 of the capillary tube 18 whilst checking that the piston 16 enters the capillary 18 without fouling. For this, it is wise not to use for the abutment surface 44 a continuous circular lip, but rather a plurality of dimples or ribs disposed at a constant angular separation. This particular arrangement of the abutment surface 44 avoids the point of the piston 16 coming into abutment with a continuous snaring lip. It should equally be noted that penetration into the end fitting 24 and into the capillary tube 18 is eased by the presence of the inclined interior wall 52 of the end fitting 24.

When the piston 16 and the end fitting 24 of the capillary tube are thus rapidly fitted in place, it is then essential to ensure that the piston 16 in fact occupies the lowermost limited position in its capillary tube, that is to say that it is necessary to make an adjustment of the zero of the pipette or to effect its calibration. Thanks to the arrangement according to the invention, this calibration can very easily be effected by simple pressure exerted on the pressure button provided on the upper end of the control rod 22 of the pipette. Such pressure on the control rod 22 completely compresses the second spring to just attain the position shown in FIG. 2. In the course of this additional stroke, as a result of the partial compression of the second spring, the resilient fingers 28 of the gripping device 14 open on descending so as to press on the upper face of the flange 42 of the piston 16. On continuing the compression of the second spring, a supplementary stroke of the movable portion is made, so that the lower face of the flange 42 comes into abuttment on the internal abuttment surface 44 arranged on the interior wall of the end fitting 24. At this stage the operator will feel a point of resistance and will release his pressure exerted on the control rod 22. One thus has the certainty that the piston 16 occupes the correct position in the capillary tube 18, the calibration of the pipette being thus achieved in a very easy manner with perfect precision.

It should be noted that in the position shown in FIG. 2, the second spring is not yet completely compressed. A supplementary pressure exerted on the pressure button on the control rod 22 permits assurance of the complete compression of the second spring beyond the point corresponding to the position shown in FIG. 2. In this case, the resilient fingers 28 of the gripping device 14 always remain open, which permits freeing of the grip on the piston 16, then during the said complementary downwards stroke the resilient fingers 28 exert a pressure on the flange 42, which is transmitted to the abutment 44 and thus to the end fitting 24 which can thus be disconnected from the rest of the pipette. Such an ejection can be obtained without any risk of loss of the end fitting in normal use, by example thanks to the method of the particular arrangement described. It may be seen on FIG. 2, that the inner surface of the upper part of the end fitting 24 has at least one annular zone 54 raised or recessed to be adapted to cooperate elastically with a corresponding recessed or raised annular zone on the external side surface of the lower part 12 of the body of the pipette. These raised or recessed annular zones 54,56 are arranged in a manner to permit a large location seat on the end of the pipette, for example of the order of 5 to 10 mm, preferably of the order of 6 to 8 mm. On the other hand, these raised or recessed annular zones 54,56 are equally arranged in a manner to ensure a small engagement and disengagement stroke of the end fitting 24, of the order of 2 mm.

Figure 3:
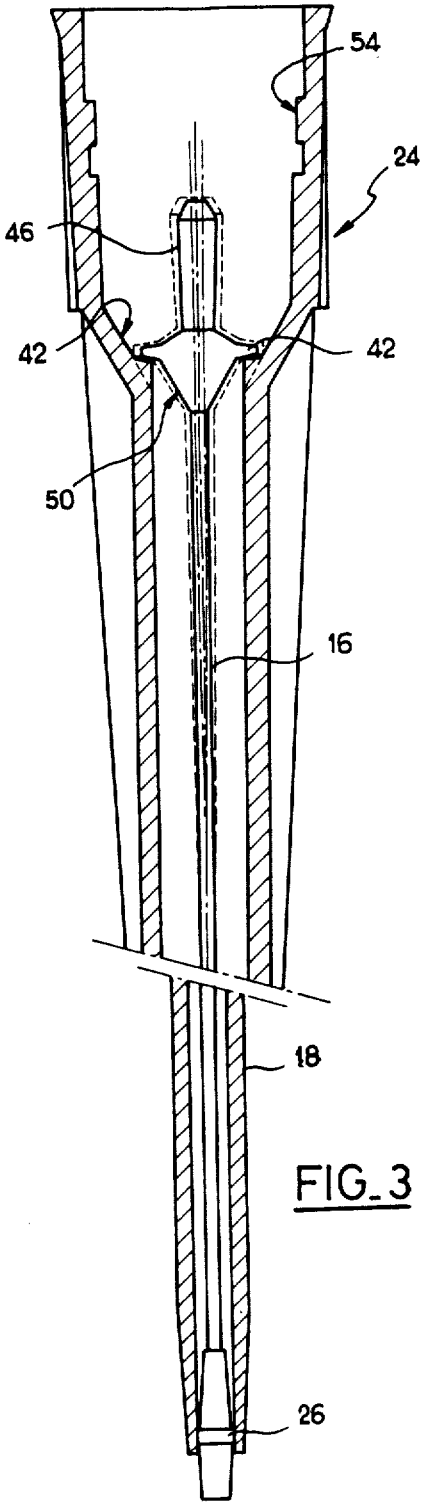
FIG. 3 shows the assembly consisting of an end fitting of the capillary tube in which is housed a piston, such that they can be stocked together, the one in the other, with a view to their being fitted together on to the body of the pipette.

According to the other possibility, it is possible to stock, for example in a rack, the assembly made up of the end fitting 24 of the capillary tube and the piston 16 already in position such as is shown in FIG. 3. From this figure it can be seen that the lower face of the flange 42, and in particular the annular peripheral zone perpendicular to the axis of the piston 16, perform a supplementary function of maintaining the piston 16 in the capillary tube 18, thus avoiding all risk of the piston sliding down and in consequence escaping from the end fitting 24 of the capillary tube 18. From examination of FIG. 3 may be understood the importance of providing a centring arrangement on the lower surface of the flange 42, for example in the form of the cone 50, in order to ensure the correct positioning of the boss 46 of the piston 16 which is intended to enter the orifice 48 arranged between the resilient fingers of the gripping device 14. These centring means in effect permit a certainty of alignment, when one comes to engage the lower part of the body of the pipette in the end fitting 24. This operation is obviously achieved having first taken care to put pressure on the pressure button of the control rod 22 in opposition to the first and second springs in order to open the resilient fingers 28 of the gripping device 14, which are intended to receive the boss 46 of the piston 16. In this case the calibration as previously described is automatically achieved as the piston already occupies its correct position in the capillary tube 18. It is always possible to repeat the preceding operation to be sure of a good calibration.

It will easily be understood that such an arrangement providing a space at the bottom of the gripping device obviates all incidents of eventual clogging at the bottom of the orifice 48 of the gripping device 14.

It should be noted that the invention is not intended to be limited to the above particularly described embodiments, but it is perfectly possible, without departing outside the scope of the present invention, to envisage a number of variants.

I claim:

1. A positive displacement precision pipette for sampling and dispensing small quantities of liquid comprising:

a body of said pipette, a capillary tube having an end fitting, said end fitting and said body being complimentarily adapted for removable engagement of said capillary tube on said body, a piston including an upper end movable in a fluid-tight manner in said capillary tube and a device for gripping the upper end of said piston for movement thereof said gripping device including a free end;

wherein said end fitting of said capillary tube has:

an abutment surface arranged on the interior surface of said end fitting; and wherein said piston has:

a flange in the region of the upper end of said piston intended to be gripped by said gripping device, said flange being adapted to cooperate at its upper face with the free end of said gripping device and at its lower face with said abutment surface.

2. A pipette according to claim 1, wherein said gripping device has:

a plurality of resilient fingers which open radially for gripping the upper end of said piston and which at the bottom of a stroke of said gripping device extend at least partially out of said body of said pipette, and wherein said flange has a transverse dimension substantially equal to the exterior diameter of said resilient fingers, in their splayed open state.

3. A pipette according to claim 1 wherein the lower face of said flange forms at least one annular peripheral zone, and defines an abutment surface substantially perpendicular to the axis of the piston.

4. A pipette according to claim 1, wherein the upper face of said flange is formed in a manner so as to be completely matable against the free end of said gripping device.

5. A pipette according to claim 4, wherein a central part of the upper face of said flange has a conical profile.

6. A pipette according to claim 1, wherein said piston has:

a substantially cylindrical boss in which the upper end of said piston ends beyond said flange, said boss being intended to be gripped in an orifice in said gripping device, and said boss including an axial direction extending as far as an upper surface of said flange being shorter than the height of said orifice in said gripping device.

7. A pipette according to claim 1, wherein the lower face of said flange has, in its central part:

means for centring the upper part of said piston.

8. A pipette according to claim 7, wherein said centering means are in the form of a central conical profile arranged at the lower face of said flange said conical profile being of a diameter slightly smaller than the interior diameter of said capillary tube.

9. A pipette according to claim 6, wherein the lower face of said flange has, in its central part:

means for centring the upper part of said piston, and wherein said flange, said boss and said centring means are of a single and the same piece of moulded plastic material.

10. A capillary tube and a piston for a positive displacement precision pipette having a piston gripping device including a free end, said piston including an upper end, wherein said capillary tube has:

an end fitting adapted for removable engagement of said capillary tube on said pipette; and wherein said end fitting of said capillary tube has:

an abutment surface arranged on the interior surface of said end fitting; and wherein said piston has:

a flange in the region of the upper end of said piston intended to be gripped by said gripping device, said flange being adapted to cooperate at its upper face with the free end of said gripping device and at its lower face with said abutment surface.

* * * * *